US005333361A

United States Patent [19]

Schaede

[11] Patent Number: 5,333,361

[45] Date of Patent: Aug. 2, 1994

[54] KEEPER CLIP

[75] Inventor: Peter Schaede, Carrum Downs, Australia

[73] Assignee: W. A. Deutsher Pty. Ltd., Moorabbin, Australia

[21] Appl. No.: 995,412

[22] Filed: Dec. 18, 1992

[51] Int. Cl.[5] ..... A44B 1/04

[52] U.S. Cl. ..... 24/182; 24/16 PB; 24/30.5 R

[58] Field of Search ..... 24/2.5, 182, 193, 197, 24/198, 200, 462, 545, 546, 555, 559, 563, 490, 492, 496, 499, 517, 518, 520, 522, 526, 528, 527, 30.5 R, 16 PB

[56] References Cited

U.S. PATENT DOCUMENTS

| | | | |
|---|---|---|---|
| 3,551,965 | 1/1971 | Gordon | 24/30.5 R X |
| 3,823,443 | 7/1974 | Takabayashi | 24/487 X |
| 4,439,896 | 4/1984 | Matsui | 24/16 PB |
| 4,592,734 | 6/1986 | Metiver | 24/16 PB X |
| 4,609,171 | 9/1986 | Matsui | 24/16 PB X |

*Primary Examiner*—Laurie K. Cranmer
*Attorney, Agent, or Firm*—Schwartz & Weinrieb

[57] ABSTRACT

A keeper clip for attachment to a belt or strap which is formed as a single piece from a plastics material. The clip includes a pair of arms which are connected at one end through a flexible bight portion and are connectable at their other end through a releaseable locking means. When the locking means is operative, the clip is in the form of a closed loop and a section of belt or strap is receivable in the space surrounded by that loop. When the locking means is released, a gate can be opened so that a section of belt or strap can be moved into or out of the aforementioned space. The locking means is operated or released by relative movement of end portions of the clip arms in a direction which is substantially transverse to the direction of relative movement of those end portions during opening or closing of the gate.

20 Claims, 2 Drawing Sheets

KEEPER CLIP

FIELD OF THE INVENTION

This invention relates to keeper clips of the kind used to attach an item to a belt or strap, By way of example, such clips are used by members of the armed forces to attach pouches, packs and equipment to webbing belts. It will be convenient to hereinafter, describe the invention with particular reference to that exemplified use, but the invention has wider application.

BACKGROUND OF THE INVENTION

Keeper clips of the foregoing kind are typically made of steel and are in the form of an elongate closed loop having two flat sides which are separated by distance sufficient to receive at least one thickness of a belt or strap between them. End portions of the section of material which form the loop overlap at one of the flat sides to provide a gate through which the belt or strap may be moved laterally into and out of the clip. For the purpose of such attachment or detachment, the overlapping end portions of the clip need to be forced apart to permit passage of the belt or strap. Furthermore, it is necessary to crumple the belt or strap transversely in order to get the belt or strap completely through the gate during the attachment operation. The same process is necessary in order to get the strap or belt through the gate for the detachment operation. Attachment and detachment of such a clip is therefore an inconvenient and time consuming operation.

Another problem with metal keeper clips is that they are quite heavy, and consequently they can add significantly to the weight of the equipment carried by a member of the armed forces. They are also relatively expensive to manufacture. In addition, the use of metal keeper clips on equipment worn by members of the armed forces presents a danger because such clips are radar reflective.

OBJECTS OF THE INVENTION

It is an object of the present invention to provide a keeper clip which is convenient to use and which is secure in operation. It is a further object of the invention, in a preferred form, to provide such a keeper clip which is of relatively light weight, is relatively inexpensive and is not radar reflective. It is another object of the invention to provide such a keeper clip which requires deliberate manipulation in order to be opened to receive a belt or strap, and which can be thereafter closed to be positively secured against lateral separation from the belt or strap.

SUMMARY OF INVENTION

According to the invention, there is provided a keeper clip for attachment to a belt or strap including, two arms, means connecting one end portion of each arm to the corresponding end portion of the other arm, a gate which is opened or closed by relative movement of the other end portions of said arms, and releasable locking means operable to hold said gate closed, wherein said clip forms a closed loop when said gate is closed, and a section of a belt or strap can be moved into or out of the space surrounded by that loop when said gate is open.

It is preferred that the clip has a resilient bias such that the gate opens automatically in response to release of the locking means. It is therefore not necessary to force the belt or strap through the gate as in the case of prior clips.

The clip is ideally made of a material which is of relatively light weight and which is not radar reflective. Preferably, the clip is made of a strong yet flexible plastic material, and it may be moulded or otherwise formed from such a material. It is further preferred to form the clip as a single piece.

In one particular arrangement, the two arms form respective opposite flat sides of the clip, and the gate is opened by moving the arms apart in the location of the gate. That is, the separation between the arms is increased at that location. It is preferred that engagement and release of the locking means also involves relative movement of the two arms, and it is further preferred that such movement is in a direction substantially transverse to the direction of movement which causes the gate to open or close.

According to a preferred arrangement, operation of the locking means involves two stages. During a first stage the two arms are held against separation so that the gate is effectively closed, but the arms are nevertheless capable of relative movement in the aforementioned transverse direction. During the second stage the locking means operates to secure the two arms against relative movement in that transverse direction. Thus, in the fully engaged condition of the locking means, the gate is held closed and relative movement of the two arms is substantially prevented.

BRIEF DESCRIPTION OF THE DRAWINGS

It will be convenient to hereinafter describe the invention in greater detail by reference to the accompanying drawings which show one particular embodiment of the invention. The particularity of those drawings is not to be understood as superseding the generality of the succeeding description. In addition, it is further understood that like or corresponding parts are designated by similar reference characters throughout the several views, and wherein.

DETAILED DESCRIPTION OF THE PREFERRED EMBODIMENT

Figure 1:
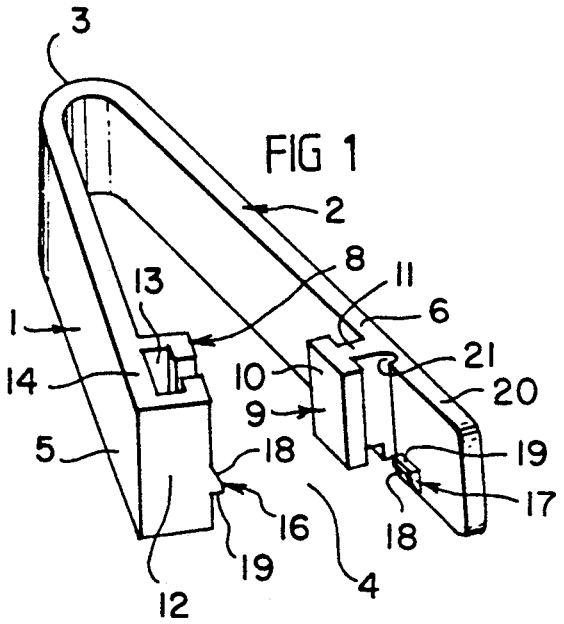
FIG. 1 is a perspective view of a clip according to one embodiment of the invention and which shows the clip in a gate open condition.

The clip as shown in the drawings is formed as a single piece, preferably from a plastic material, and includes two elongate arms 1 and 2 which are connected at one end through a curved bight portion 3. In the particular arrangement shown, each of the arms 1 and 2 is in the form of a flat strip or bar of substantially constant thickness, and the bight portion is of slightly reduced thickness so as to have greater flexibility than the arms 1 and 2. It is preferred that the bight portion 3 is stressed as a consequence of moving the arms 1 and 2 from the gate open position of FIG. 1 to the gate closed position of FIG. 5. The developed stress is such that the bight portion 3 acts in the manner of a spring so as to normally urge the arms i and 2 into the gate open position. In the as-moulded condition of the clip, the arms 1 and 2 may have a relative arrangement substantially as shown in FIG. 1.

The gate 4 is shown formed between the end portions 5 and 6 of the arms 1 and 2 remote from the bight portion 3, but it could be otherwise located. For example, it could be located part way along the length of either one of the arms 1 and 2.

Figure 5:
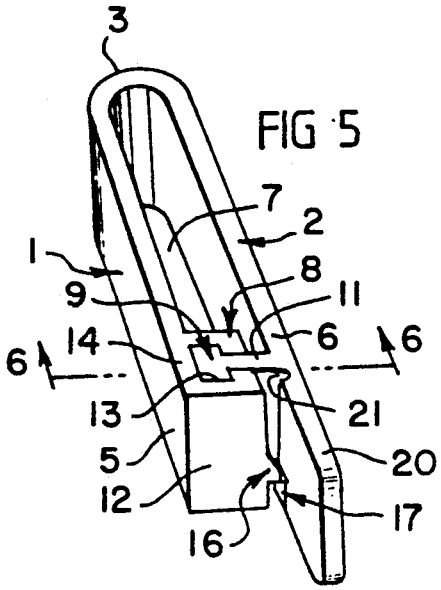
FIG. 5 shows the clip in the gate closed and locked position.

Any suitable locking means may be adopted for holding the clip in the gate closed position as shown in FIG. 5. In that position, the clip forms a closed loop which surrounds a space 7 having dimensions such as to receive a section of a belt or strap of the kind with which the clip is to be used.

In the particular embodiment shown, the locking means includes two interengageable parts 8 and 9 which cooperate to positively hold the arm end portions 5 and 6 against moving apart to adopt the gate open position. It is a feature of the two parts 8 and 9 that they are relatively arranged so that disengagement requires relative movement of the am end portions 5 and 6 in a direction transverse to the direction of relative movement which is needed to open the gate 4.

The parts 8 and 9 of the particular locking means shown constitute female and male parts respectively. The male part 9 comprises a slide plate 10 which is connected to the arm 2 through a web 11 extending transverse of the arm 2. The plate 10 and the web 11 are relatively arranged so that they combine to form a substantially T shape rib, but such a configuration is not essential to performance of the locking means. In the arrangement shown, the rib formed by the plate 10 and the web 11 has its longitudinal axis arranged substantially transverse to the longitudinal axis of the arm 2. The female part 8 of the embodiment shown comprises a block 12 having a recess in the form of a slot 13 which has a cross-sectional shape substantially complementary to the cross-sectional shape of the rib which forms the male part 9. The arrangement is such that the rib 9 can be slid longitudinally into and out of the slot 13.

Figure 4:
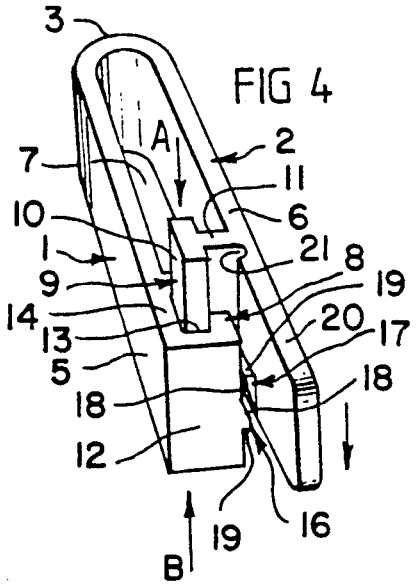
FIG. 4 is a view similar to FIG. 1 but showing the clip in a gate closed condition and the arms being moved towards a gate locked condition.
Figure 2:
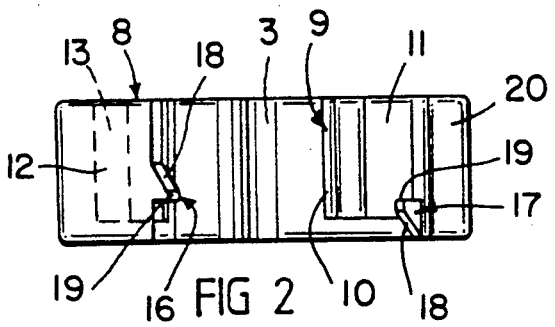
FIG. 2 is an end view of the clip as shown in FIG. 1.
Figure 3:
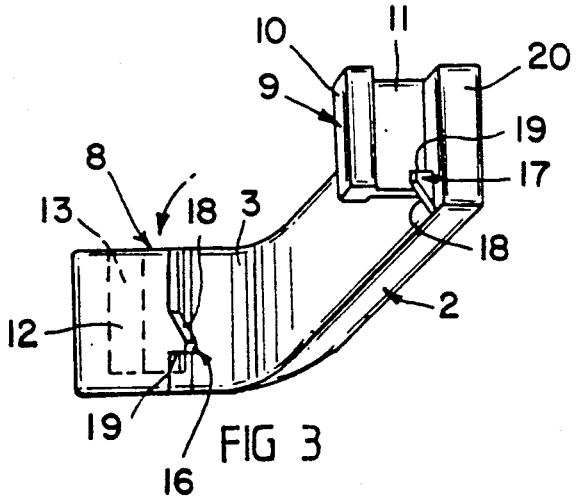
FIG. 3 is a view similar to FIG. 2 but showing the arms of the clip twisted and moved towards one another at one end so as to effect a gate closed condition.

FIG. 4 shows the rib 9 being moved into the slot 13. In order to reach the FIG. 4 condition, it is first necessary to arrange the rib 9 in end to end longitudinal alignment with the slot 13. That is achieved by moving the arm end portions 5 and 6 towards one another, and also forcing those end portions 5 and 6 out of alignment as shown in FIG. 3 so that the rib 9 can be located over the surface 14 of the block 12. The bight portion 3 flexibly distorts to permit the male part 9 to be so located. The internal stress created by that distortion then produces a spring effect which assists movement of the rib 9 along the groove 13 towards the position shown in FIG. 5.

Figure 6:
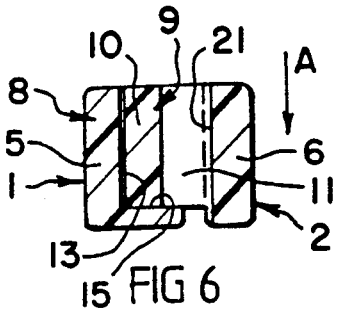
FIG. 6 is a cross-sectional view taken along line 6—6 of FIG. 5.

Stop or blocking means is preferably provided to prevent the rib 9 being moved through the slot 13 beyond the lock engaged position as shown in FIG. 3. In the construction shown, that stop means is formed by a wall 15 (FIG. 6) which extends across the end of the slot 13 remote from its open mouth, which is at the surface 14. As shown in FIG. 6, the rib 9 engages against the wall 15 to prevent further movement of the rib 9 in the direction of arrow A relative to the female part 8. In order to release the locking means, the rib 9 needs to be moved relative to the female part 8 in the direction of arrow B (FIG. 4).

It is preferred that detent means is provided to positively prevent separation of the male and female parts 9 and 8. That detent means may be formed by cooperable ratchet elements 16 and 17 provided On the arms 1 and 2 respectively. In the construction shown, each of the elements 16 and 17 has a sloping ramp surface 18 and an abrupt stop surface 19. The element 17 is preferably provided on an extension 20 of the arm 2 which is able to flex relative to the main body of the arm 2.

Figure 7:
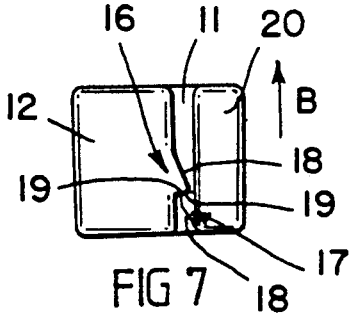
FIG. 7 is an end view of the clip in the condition as shown in FIG. 5.

The ramp surfaces 18 engage with one another during movement of the arms 1 and 2 into the lock engaged position. Continued relative movement of the arms 1 and 2 into that position is made possible by the extension 20 flexing so that the two elements 16 and 17 can ride over one another. When the element 17 is moved beyond the element 16 in a direction towards the wall 15, the extension 20 springs back towards the unflexed condition and thereby brings the two stop faces 19 into opposed relationship as shown in FIG. 7. Longitudinal movement of the rib 9 out of the groove 13 in the direction of arrow B is thereby prevented.

Figure 8:
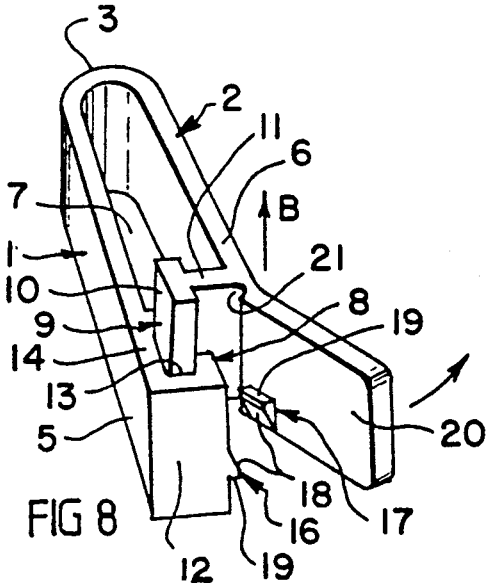
FIG. 8 is a view similar to FIG. 4 and showing the clip being moved towards a condition at which the gate can be opened.

Release of the locking means is effected by flexing the arm extension 20 as shown in FIG. 8 so that the element 17 is moved clear Of the element 16. Movement of the rib 9 in the direction of arrow B is then permitted. The am extension 20 will automatically return to the unflexed position when the force causing it to flex is removed.

Flexing of the am extension 20 may be facilitated by forming a transverse groove 21 at or near the junction between the extension 20 and the main body of the arm 2. It will be apparent that a suitable line of weakness could be created in other ways to achieve the same effect.

With the arrangement described, the locking means is operated in two stages. During a first stage, as shown in FIG. 4, the rib 9 is partially located within the slot 13. Because of that partial location, the gate 4 cannot be opened, but the locking means is not finally secured because it remains possible to move the rib 9 out of the slot 13 and thereby permit the gate 4 to be opened.

The second stage is completed when the ratchet elements 16 and 17 ride over one another to adopt the condition shown in FIGS. 5 and 7, and that occurs as the rib 9 is fully contained, or is substantially fully contained, within the slot 13. Progression through the second stage requires resilient deformation of one part of the locking means, which in the embodiment particularly described involves deflection of the am extension 20 as shown in FIG. 8. The same kind of deflection or resilient deformation is required to release the second stage of the locking means such that the rib 9 can be moved out of the slot 13.

A clip as described has the advantage of convenient attachment to, and detachment from, a belt or strap. Furthermore, when in the lock engaged position, the clip is securely fastened around e belt Or strap such that inadvertent detachment is unlikely. It is a further advantage of the invention to be able to form the clip as a single piece member from a plastic material.

Various alterations, modifications and/or additions may be introduced into the constructions and arrangements of parts previously described without departing from the spirit or ambit of the invention as defined by the appended claims. It is therefore to be understood that within the scope of the appended claims, the present invention may be practiced otherwise than as specifically described herein.

Having now described my invention, what I claim as new and desire to secure by Letters Patent is:

1. A keeper clip for attachment to a belt or strap, comprising:

two arms;

means connecting one end portion of each one of said arms to the corresponding end portion of the other one of said arms;

a gate which is opened or closed by relative movement of the other end portions of said arms in a first direction; and releasable locking means, operable to hold said gate closed when said releasable locking means is disposed in a locked state and permitting said gate to be opened when said releasable locking means is disposed in an unlocked state, provided upon said other end portions of said arms and movable with respect to each other only in a direction transverse to said first direction so as to achieve said locked and unlocked states, whereby said clip forms a closed loop when said gate is closed so as to retain a section of said belt or strap within the space surrounded by said closed loop, and said section of said belt or strap can be moved into or out of said space surrounded by said loop when said gate is open.

2. A keeper clip according to claim 1, wherein said clip is formed as a single piece and is formed of a plastic material.

3. A keeper clip according to claim 1, wherein said locking means includes two interengageable parts, each of which is connected to a respective one of said arms.

4. A keeper clip according to claim 3, wherein:

said parts are snap-engageable so as to permit said locking means to achieve a securely locked position; and one of said parts is resiliently deformable so as to permit release of said locking means from said securely locked position and consequent adoption of said gate-open condition.

5. A keeper clip according to claim 4, wherein said one part resiliently deforms during said snap engagement.

6. A keeper clip according to claim 3, wherein one of said parts includes a recess, the other said part includes a keying element which is receivable in said recess, and detent means is operable to prevent removal of said keying element from said recess.

7. A keeper clip according to claim 6, wherein at least one of said parts is resiliently deformable to render said detent means inoperable to prevent said removable of the keying element.

8. A keeper clip according to claim 6, wherein:

blocking means is provided so as to limit movement of said keying element into said recess to movement in one direction and to a predetermined extent, and to permit movement of said keying element out of said recess to movement only in a direction which is opposite to said one direction.

9. A keeper clip according to claim 6, wherein:

said locking means is rendered operable in two stages; and opening of said gate is prevented when said locking means is disposed at either a first one of said two stages of operation or at a second one of said two stages of operation.

10. A keeper clip according to claim 9, wherein said two parts engage one another during said first stage of operation, and such engagement is achieved or broken by relative movement of said other end portions in said direction substantially transverse to said first direction of relative movement of said other end portions during opening or closing of said gate.

11. A keeper clip according to claim 10, wherein the extent of said engagement between said parts increases as said locking means is moved towards said second stage, of operation and said detent means is rendered operative during said second stage of operation.

12. A keeper clip according to claim 6, wherein said keying element is a rib of substantially T shape in transverse cross-section having its longitudinal axis extending substantially transverse to the longitudinal axis of the arm to which it is connected, said recess is a slot having a transverse cross-sectional shape substantially complimentary to that of said rib, and the arrangement is such that location of said rib in said slot positively resists relative movement of said other end portions of the arms in any direction other than a direction substantially parallel to the longitudinal axis of the rib.

13. A keeper clip according to claim 12, wherein said detent means includes two cooperable ratchet elements each of which is connected to a respective one of said arms and which are arranged to engage each other when said rib is substantially fully contained within said slot.

14. A keeper clip according to claim 13, wherein said other part includes a longitudinal extension of said arm to which said other part is connected, one of said ratchet elements is provided on said longitudinal extension and said extension is movable about a line of weakness so as to thereby disengage said ratchet elements.

15. A keeper clip according to claim 12, wherein said slot is open at one end to receive said rib and is at least partially closed at the other end by an end wall which prevents movement of said rib into or out of said other end.

16. A keeper clip according to claim 1, wherein said connecting means is a curved bight portion.

17. A keeper clip according to claim 16, wherein said bight portion is pre-stressed so as to tend to cause said gate to open when said locking means is released.

18. A keeper clip as set forth in claim 1, wherein:

said two arms are normally substantially coplanar with respect to each other when said releasable locking means are disposed in said locked and unlocked states; and said flexible means connecting said one end portions of said two arms together permits said other end portions of said two arms to be moved out of their normal coplanar alignment with respect to each other such that said releasable locking means, disposed upon said other end portions of said two arms, can be moved with respect to each other along said transverse direction so as to permit said releasable locking means of said other end portions of said two arms to achieve said locked and unlocked states, said movement of said other end portions of said two arms out of their normal coplanar alignment with respect to each other serving to develop a biasing force which tends to bias said other end portions of said two arms toward said normal coplanar alignment with respect to each other and to likewise bias said releasable locking means toward said locked state.

19. A single-piece keeper clip for attachment to a belt or strap and formed of a plastic material, comprising:

two arms;

means connecting one end portion of each one of said arms to the corresponding end portion of the other one of said arms, and which is flexible so as to permit relative movement of the other end portions of said arms with respect to each other;

a gate which is opened or closed by said relative movement of said other end portions of said arms in a first direction; and releasable locking means, operable to hold said gate closed when said releasable locking means is disposed in a locked state and permitting said gate to be opened when said releasable locking means is disposed in an unlocked state, comprising two interengageable parts provided upon said other end portions of said arms and having predetermined configurations such that said two interengageable parts are capable of movement with respect to each other only in a direction which is transverse to said first direction so as to achieve said locked and unlocked states;

whereby said clip forms a closed loop when said gate is closed so as to retain a section of said belt or strap within the space surrounded by said closed loop, and said section of said belt or strap can be moved into or out of said space surrounded by said loop when said gate is open.

20. A keeper clip as set forth in claim 19, wherein:

said two arms are normally substantially coplanar with respect to each other when said releasable locking means are disposed in said locked and unlocked states; and said flexible means connecting said one end portions of said two arms together permits said other end portions of said two arms to be moved out of their normal coplanar alignment with respect to each other such that said releasable locking means, disposed upon said other end portions of said two arms, can be moved with respect to each other along said transverse direction so as to permit said releasable locking means of said other end portions of said two arms to achieve said locked and unlocked states, said movement of said other end portions of said two arm out of their normal coplanar alignment with respect to each other serving to develop a biasing force which tends to bias said other end portions of said two arms toward said normal coplanar alignment with respect to each other and to likewise bias said releasable locking means toward said locked state.

* * * * *